US009643759B2

(12) United States Patent
Fily

(10) Patent No.: US 9,643,759 B2
(45) Date of Patent: May 9, 2017

(54) CLOSURE FOR CONTAINER, COMBINATION THEREOF, AND METHOD OF USING SAME

(71) Applicant: Galderma R&D, Sophia Antipolis (FR)

(72) Inventor: Sebastien Fily, Sophia Antipolis (FR)

(73) Assignee: Galderma R&D, Sophia Antipolis (FR)

( * ) Notice: Subject to any disclaimer, the term of this patent is extended or adjusted under 35 U.S.C. 154(b) by 277 days.

(21) Appl. No.: 13/729,208

(22) Filed: Dec. 28, 2012

(65) Prior Publication Data

US 2014/0185964 A1 Jul. 3, 2014

(51) Int. Cl.

| | |
|---|---|
| ***B65D 47/28*** | (2006.01) |
| ***B65D 75/58*** | (2006.01) |
| *B65D 5/74* | (2006.01) |

(52) U.S. Cl.

CPC ..... *B65D 47/286* (2013.01); *B65D 75/5883* (2013.01); *B65D 5/746* (2013.01)

(58) Field of Classification Search

CPC ..... B65D 47/28; B65D 47/286; B65D 75/58; B65D 33/2591; B65D 83/0805; B65D 75/5883; B65D 5/746; Y10T 24/158

USPC ..... 383/68, 69, 78; 24/437–441

See application file for complete search history.

(56) References Cited

U.S. PATENT DOCUMENTS

| | | | | |
|---|---|---|---|---|
| 1,578,077 A | | 3/1926 | Courney | |
| 1,897,890 A | * | 2/1933 | Cook | 222/542 |
| D89,544 S | | 3/1933 | Inocencio | |
| 2,111,482 A | | 3/1938 | Ruetz | |
| 2,370,997 A | | 3/1945 | Rudolph | |
| 2,464,312 A | | 3/1949 | Holden | |
| 3,422,997 A | * | 1/1969 | Anderson | 222/542 |
| 4,505,400 A | * | 3/1985 | Bennett | 215/250 |
| 4,722,614 A | | 2/1988 | Boynton | |
| 4,925,043 A | * | 5/1990 | Dinand | 215/322 |
| 5,115,949 A | * | 5/1992 | Rosenthal | 222/211 |
| 5,116,758 A | * | 5/1992 | Verma | 435/304.1 |
| 5,405,034 A | * | 4/1995 | Mittel, Jr. | 215/322 |
| 5,555,995 A | * | 9/1996 | Galer | 220/345.3 |
| 5,687,885 A | * | 11/1997 | Turk et al. | 222/512 |

(Continued)

FOREIGN PATENT DOCUMENTS

| | | |
|---|---|---|
| BE | 509640 A | 3/1952 |
| CH | 224936 A | 12/1942 |

(Continued)

OTHER PUBLICATIONS

Int'l Search Report and Written Opinion issued Apr. 8, 2014 in Int'l Application No. PCT/US2013/077837.

*Primary Examiner* — Peter Helvey
(74) *Attorney, Agent, or Firm* — Panitch Schwarze Belisario & Nadel LLP

(57) ABSTRACT

A closure for a container including a base having a passageway extending therethrough. At least a portion of the base is configured to attach to at least a portion of an opening of a container such that the passageway is in registry with at least a portion of the opening. A cap is movably attached to the base. The cap is movable between a first position in which at least a portion of the cap blocks at least a portion of the passageway and a second position in which the cap is spaced-apart from at least a portion of the passageway to allow contents from within the container to pass therethrough. A seal is positioned on one of the cap and the base.

9 Claims, 4 Drawing Sheets

(56) References Cited

U.S. PATENT DOCUMENTS

| | | | | |
|---|---|---|---|---|
| 5,704,471 | A | 1/1998 | Yamada | |
| D437,687 | S | 2/2001 | Salz | |
| D592,972 | S | 5/2009 | Beam et al. | |
| D621,157 | S | 8/2010 | Achilles | |
| 8,043,005 | B2 | 10/2011 | Lyon et al. | |
| 2012/0012585 | A1* | 1/2012 | Sinacori et al. | 220/254.9 |
| 2012/0205371 | A1* | 8/2012 | Lee | 220/8 |
| 2012/0312816 | A1* | 12/2012 | Barreto et al. | 220/254.7 |
| 2013/0320017 | A1* | 12/2013 | Kientzle et al. | 220/345.3 |
| 2014/0185964 | A1 | 7/2014 | Fily | |
| 2014/0367385 | A1* | 12/2014 | Spiegelhoff et al. | 220/345.4 |

FOREIGN PATENT DOCUMENTS

| | | | |
|---|---|---|---|
| FR | 2459762 | A1 | 1/1981 |
| GB | 443066 | A | 2/1936 |
| GB | 468549 | A | 7/1937 |
| LU | 29731 | A | 9/1949 |

* cited by examiner

CLOSURE FOR CONTAINER, COMBINATION THEREOF, AND METHOD OF USING SAME

BACKGROUND OF THE INVENTION

The present invention relates generally to a closure for a container and, more particularly, to a relatively small, thin and/or flat device that permits selective opening and closing of a flexible container to dispense even small amounts of contents therefrom.

Flexible containers, such as pouches, sachets, transparent polymeric bags and the like, are well-known for at least temporarily holding or storing a variety of items, such as office supplies, jeweler, bathroom or travel accessories, foodstuff (both solids and liquids) and the like. One such conventional flexible container is sold under the name ZIPLOC. While conventional flexible containers are quite versatile and beneficial, such containers provide a relatively wide opening, such that controlling the release of the contents from within the containers can be difficult.

It is heretofore not been discovered how to create a closure for a flexible container or a combination thereof that is relatively small, flat and/or thin, and allows a user to easily release or dispense a desired amount of the contents from the container. The present invention accomplishes the above objectives and overcomes the above-described disadvantages of conventional flexible containers.

BRIEF SUMMARY OF THE INVENTION

Briefly stated, one aspect of the present invention is directed to a closure for a container including a base having a passageway extending therethrough. At least a portion of the base is configured to attach to at least a portion of an opening of a container such that the passageway is in registry with at least a portion of the opening. A cap is movably attached to the base. The cap is movable between a first position in which at least a portion of the cap blocks at least a portion of the passageway and a second position in which the cap is spaced-apart from at least a portion of the passageway to allow contents from within the container to pass therethrough. A seal is positioned on one of the cap and the base. At least a portion of the seal is positioned and at least partially compressed between the cap and the base when the cap is in the first position to seal the passageway.

In another aspect, the present invention is directed to a combination including a flexible container defining a cavity for holding contents. The container includes an opening to permit access to the cavity. A closure includes a base having a passageway extending therethrough. At least a portion of the base is attached to at least a portion of the opening of the flexible container. The passageway is in communication with the cavity of the flexible container through the opening. A cap is movably attached to the base. The cap is movable between a first position in which at least a portion of the cap blocks at least a portion of the passageway and a second position in which the cap is spaced-apart from at least a portion of the passageway to allow the contents from within the cavity of the container to pass therethrough. A seal is on one of the cap and the base. At least a portion of the seal is positioned between and at least partially compressed between the cap and the base when the cap is in the first position to seal the passageway.

In yet another aspect, the present invention is directed to a method of using a combination container and closure including moving a cap of a closure with respect to a base of the closure from a first position to a second position to expose at least a portion of the passageway that extends through the base. The closure includes an opening permitting access to a cavity thereof. The method includes at least partially inverting the closure and the container to dispense contents from within the cavity of the container through the passageway of the body. The method includes moving the cap from the second position to the first position to at least partially block the passageway thereby preventing dispensing of the substance from the container. A seal between the cap and the base is at least partially compressed when the cap is in the first position, and the seal is expanded when the cap is in the second position.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
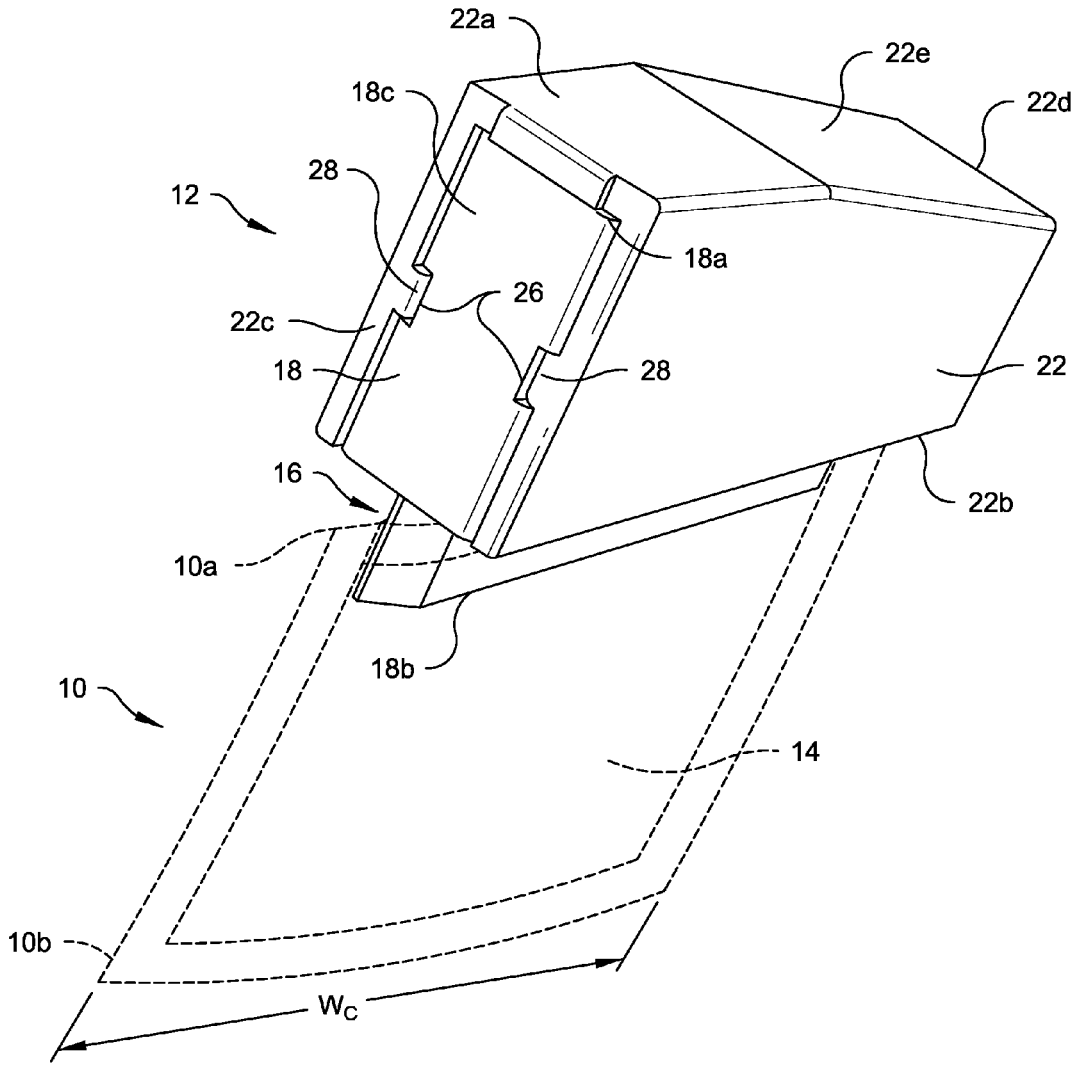
FIG. 1 is a top perspective view of a combination container and closure according to a preferred embodiment of the present invention, wherein a cap of the closure is in a first or closed position with respect to a base thereof.

Certain terminology is used in the following description for convenience only and is not limiting. The words "lower" and "upper" designate directions in the drawings to which reference is made. The words "downwardly," "inwardly" and "outwardly" refer to directions toward and away from, respectively, the geometric center of the device, and designated parts thereof, in accordance with the present invention. Unless specifically set forth herein, the terms "a," "an" and "the" are not limited to one element, but instead should be read as meaning "at least one." The terminology includes the words noted above, derivatives thereof and words of similar import.

Referring to the drawings in detail, wherein like numerals indicate like elements throughout, FIGS. 1-4 illustrate a flexible container, generally designated 10, (shown only in FIG. 1) and a closure, generally designated 12, or a combination thereof in accordance with a preferred embodiment of the present invention. The combination is preferably designed to at least temporarily store contents or a substance (not shown), such as office supplies, jewelry, bathroom or travel accessories, foodstuff (both solids and liquids) and the like, in at least a relatively gas-tight and/or liquid-tight manner. The combination and/or the closure 12 preferably allows a user to selectively release or dispense even small amounts of the contents or substance from the container 10.

The combination is preferably at least relatively small, thin and/or flat to promote ease of storage and/or transport thereof.

The container 10 is preferably formed of a flexible material, such as a polymeric material, that is relatively durable and resilient, such that the container 10 can withstand repeated use. However, the present invention is not limited to a container 10 that is flexible. For example, the container 10 may be formed of a less resilient, non-resilient or even a generally rigid material, such as a hard polymeric material or a metallic material. The container 10 is preferably at least generally transparent, but may be at least generally translucent or opaque.

Referring to FIG. 1, the container 10 preferably defines or forms a cavity 14 for holding the contents or substance. The container 10 includes an opening 16 to permit access to the cavity 14. The opening 16 is preferably formed at a first end 10*a* of the container 10. The opening 16 preferably extends generally across an entire width $W_C$ of the first end 10*a* of the container 10. However, the opening 16 may be smaller or shorter than the entire width $W_C$ of the container 10. An opposing second end 10*b* of the container 10 is preferably closed. The container 10 is preferably square or rectangular in shape. However, the container 10 is not limited to such a shape and/or configuration. For example, the container 10 may have any of a variety of sizes, shapes and/or configurations that permit the functionality described below.

Figure 2:
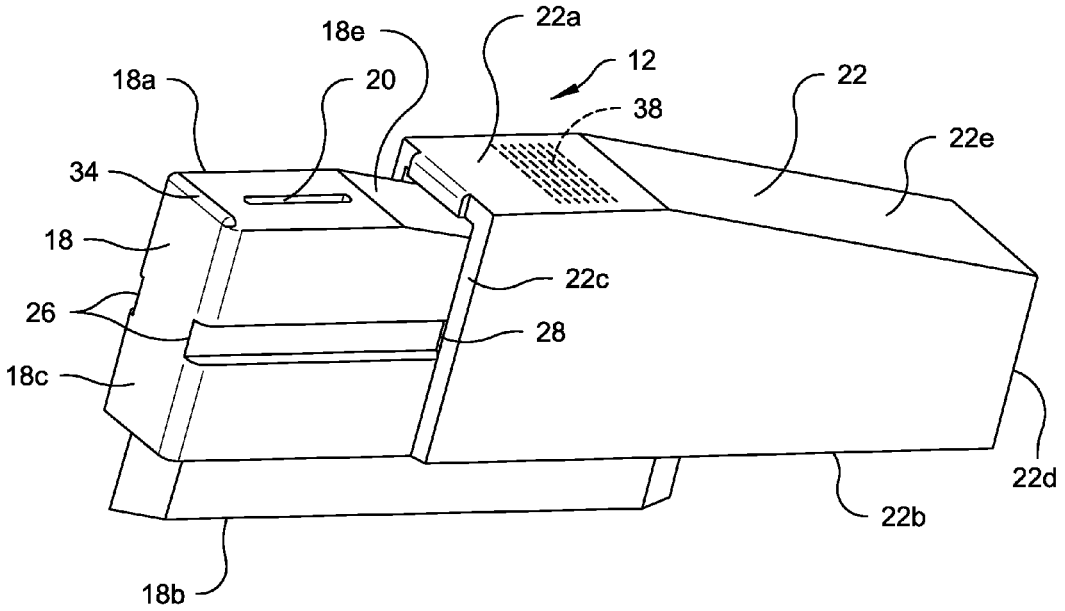
FIG. 2 is a top perspective view of the closure, wherein the cap is in a second or partially separated position with respect to the base.
Figure 3:
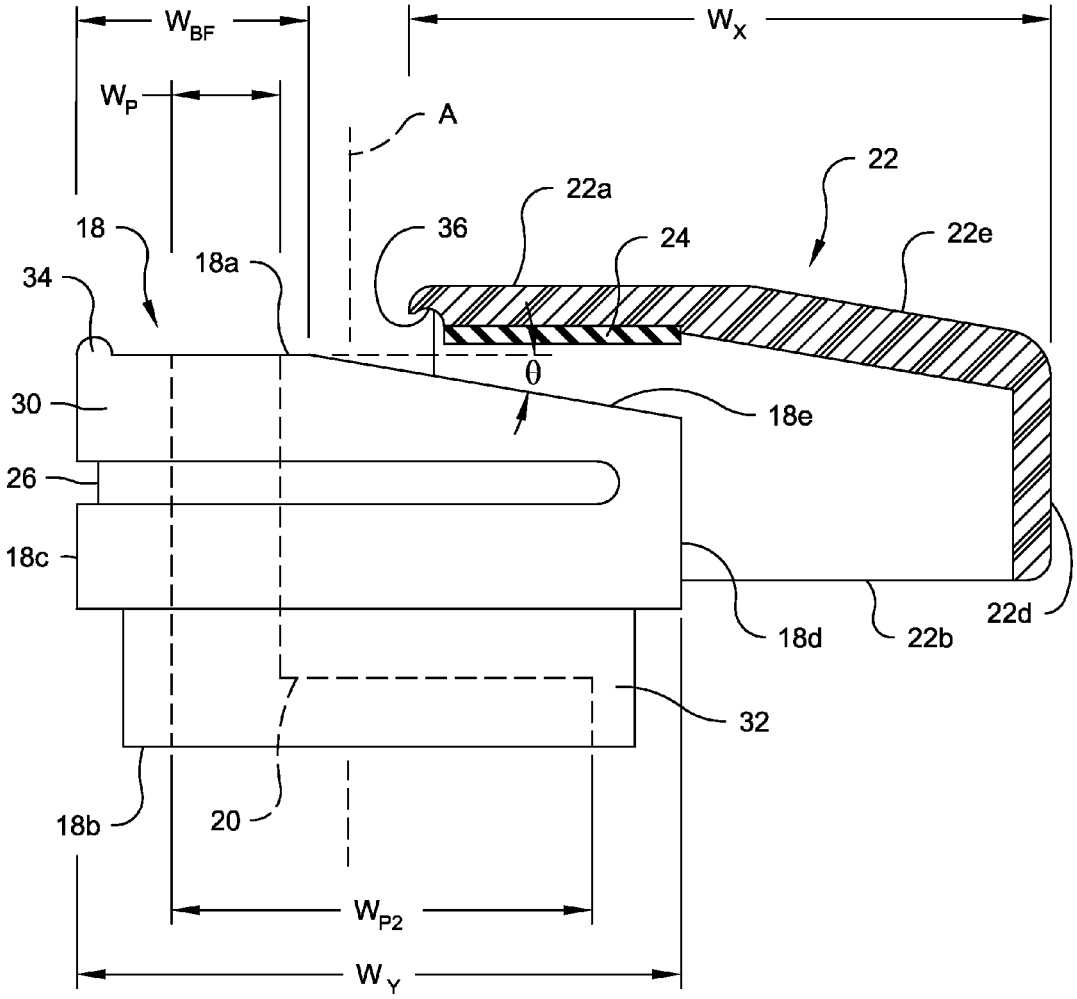
FIG. 3 is a partial cross-sectional side elevational view of the closure, wherein the cap is in the second position.

Referring to FIGS. 1-4, the closure 12 preferably includes a base 18 having a first or upper end 18*a* and an opposing second or lower end 18*b*. The first end 18*a* of the base 18 preferably extends generally, if not exactly, parallel to the second end 18*b*. As shown in FIG. 3, a longitudinal axis A of the base 18 preferably extends linearly from the first end 18*a* thereof to the second end 18*b* thereof. The base 18 also preferably includes a first sidewall 18*c* and an opposing second sidewall 18*d*, which preferably extend in parallel and generally, if not exactly, parallel to the longitudinal axis A. A sloped surface 18*e* preferably extends from and/or connects the first end 18*a* to the second sidewall 18*d*. As shown in FIG. 3, the sloped surface 18*e* preferably extends downwardly at an angle θ of approximately five to thirty degrees (5°-30°) with respect to a plane defined by the first end 18*a*. The base 18 is not limited to inclusion of the sloped surface 18*e*. In other words, the base 18 may be a generally square or rectangular shape when viewed from the side.

Referring to FIGS. 1-3, a passageway 20 preferably extends completely through the base 18. The passageway 20 is preferably spaced laterally inwardly from each of the first and second sidewalls 18*c*, 18*d* of the base 18. It is preferred that at least a portion of the passageway 20 extends at least generally, if not exactly, parallel to the longitudinal axis A from the first end 18*a* to the second end 18*b*. As shown in FIG. 3, a width $W_P$ of the passageway 20 proximate the first end 18*a* of the base 18 is preferably less than a width $W_{BF}$ of the first end 18*a*. The width $W_P$ of the passageway 20 proximate the first end 18*a* of the base 18 is at least relatively small or narrow, as compared to the opening 16 of the container 10, which allows a user to more easily dispense relatively small amounts of the contents or substance from the cavity 14 of the container 10. The width $W_P$ of the passageway 20 proximate the first end 18*a* of the base 18 is also preferably smaller than a width $W_{P2}$ of the passageway 20 proximate the second end 18*b* of the base 18. However, the passageway 20 is not limited to the size, shape and/or configuration shown in FIG. 3. Instead, the passageway 20 may have any size, shape and/or configuration that permits the functionality of the passageway 20 described herein.

The passageway 20 preferably allows the contents or substance of the container 10 to flow or move from the opening 16 of the container 10 and through the base 18 when the closure 12 is attached to the container 10. At least a portion of the base 18 is configured to attach to at least a portion of the opening 16 of the container 10 such that the passageway 20 is in registry with at least a portion of the opening 16. In other words, at least a portion of the base 18 is directly attached to at least a portion of the container 10 such that the passageway 20 of the base 18 is in communication with the cavity 14 of the container 10 through the opening 16.

Figure 4:
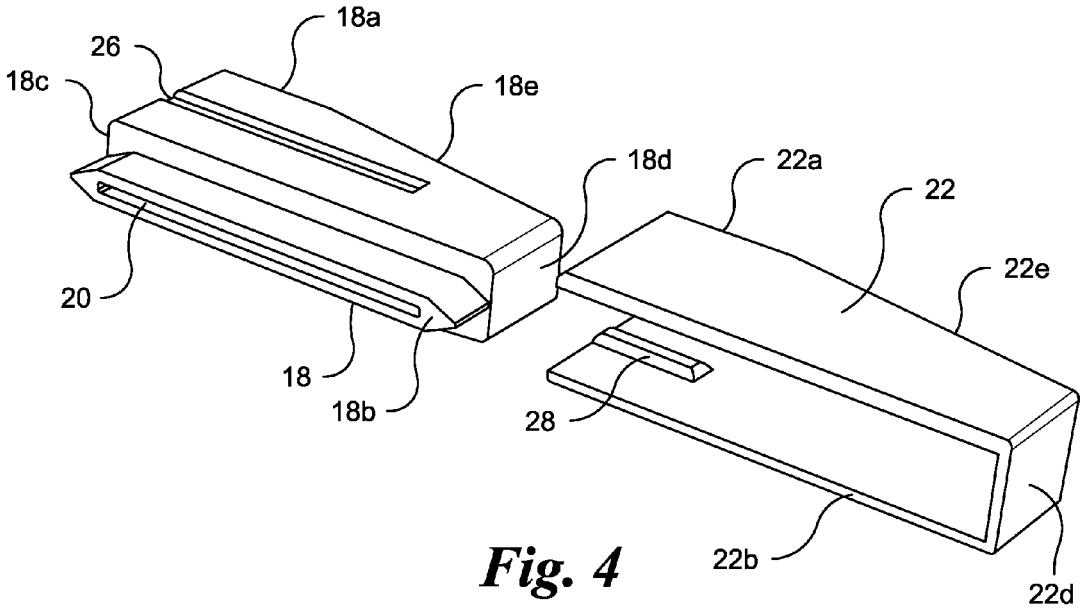
FIG. 4 is a bottom perspective view of the closure, wherein the cap is shown in a third or fully separated position with respect to the base.

Referring to FIGS. 2-4, the base 18 of the closure 12 preferably includes a first or upper portion 30 and a second or lower portion 32 fixedly attached thereto. It is preferred that the first portion 30 is integrally, unitarily and monolithically formed with respect to the second portion 32. The second portion 32 preferably has a reduced width and/or cross-sectional area as compared to the first portion 30. At least a portion of the first end 10*a* of the container 10 is fixedly attached directly to the second portion 32 of the base 18. More particularly, as shown in FIG. 1, it is preferred that at least a portion of the container 10 surrounds and tightly engages at least a portion of the second portion 32 of the base 18 and creates an air-tight and/or water-tight seal therebetween. The container 10 may be permanently attached to the second portion 32 of the base 18, such as by adhesive or a clip, clamp or other mechanical fastener, or the container 10 may be removably attached to the second portion 32 of the base 18, such as by hook-and-loop or other fasteners.

As shown in FIGS. 1-4, the closure 12 preferably includes a cap 22 movably or slidably attached to the base 18. The cap 22 moves in a direction generally, if not exactly, perpendicularly to the longitudinal axis A of the base 18. The cap 22 is preferably movable between a first or fully closed position (see FIG. 1) in which at least a portion of the cap 22 blocks at least a portion of the passageway 20 of the base 18 and a second or partially separated position (see FIGS. 2 and 3) in which the cap 22 is spaced-apart from at least a portion of the passageway 20 to allow the contents or substance from within the cavity 14 of the container 10 to pass therethrough. The cap 22 also preferably has a third or fully separated position (see FIG. 3), in which the cap 22 is spaced-apart from the base 18. Once the cap 22 is attached to the base 18 (e.g., in the first or second positions), it is preferred that the user cannot move the cap 22 to the third position. In other words, it is preferred that the cap 22 is only in the third position prior to assembling the cap 22 and the base 18.

The cap 22 preferably includes a first or upper end 22*a*, an opposing second or lower end 22*b*, a first sidewall 22*c*, an opposing second sidewall 22*d* and a sloped surface 22*e*. As shown in FIG. 2, a portion of the cap 22, such as the first end 22*a*, may include one or more raised or depressed grips 38 to increase friction between a user's finger and the cap 22 to allow the user to more easily move the cap 22 with respect to the base 18. Similar to the base 18, the first and second ends 22*a*, 22*b* preferably extend generally, if not exactly parallel. In addition, the first and second sidewalls 22*c*, 22*d* preferably extend generally if not exactly parallel. In the first and second positions, the sloped surface 22*e* of the cap 22 preferably extends generally, if not exactly, parallel to the sloped surface 18*e* of the base 18. In an embodiment where the sloped surface 18*e* of the base 18 is omitted such that the base 18 is generally square or rectangular, the sloped surface 22*e* of the cap 22 is preferably omitted such that the cap 22 is generally square or rectangular. As shown in FIG. 1, the cap 22 at least generally surrounds the entire first portion 30 of the base 18 when the cap 22 is in the first position. As shown in FIG. 3, a width $W_X$ of the cap 22, as measured generally perpendicularly to the longitudinal axis A, is preferably at least slightly greater than a width $W_Y$ of the base 18, as measured generally perpendicular to the longitudinal axis A. The width $W_X$ of the cap 22 is preferably generally equal to the width $W_C$ of the container 10.

Referring to FIGS. 1-4, at least one and preferably two spaced-apart first fastening members 26 are positioned on or in the first portion 30 of the base 18. Each first fastening member 26 preferably extends generally, if not exactly perpendicularly to the longitudinal axis A across the width $W_Y$ of the base 18. Each first fastening member 26 is spaced-apart from the first end 18*a*, the second sidewall 18*d* and the sloped surface 18*e* of the base 18. At least one and preferably at least two spaced-apart second fastening members 28 are positioned on or in the cap 22. Each second fastening member 28 preferably extends generally, if not exactly, perpendicularly to the longitudinal axis A across the width $W_X$ of the cap 22. Each second fastening member 28 is spaced-apart from the first end 22*a*, the second end 22*b*, the second sidewall 22*d* and the sloped surface 22*e* of the cap 22.

In a preferred embodiment, each first fastening member 26 includes a generally concave or rectilinear groove that extends inwardly into at least a segment of the first portion 30 of the base 18. Likewise, each second fastening member 28 preferably includes a generally convex or rectilinear rib that extends inwardly from an interior of the cap 22. Each second fastening member 28 preferably complimentarily engages one of the first fastening members 26 to properly align the cap 22 with the base 18. As shown in FIGS. 3 and 4, each first fastening member 26 preferably does not extend across the entire width $W_Y$ of the base 18. Similarly, each second fastening member 28 preferably does not extend across the entire width $W_X$ of the cap 22. As shown in FIG. 4, a length of each first fastening member 26, as measured perpendicularly to the longitudinal axis, is greater than a length of each second fastening member 28. The shorter second fastening members 28, as compared to the first fastening members 26, permit the controlled moving or sliding motion of the cap 22 with respect to the base 18, as described herein.

Referring to FIGS. 2 and 3, the base 18 preferably includes a projection 34 extending outwardly from and/or above the first end 18*a* thereof. More preferably, the projection 34 is positioned on the first portion 30 of the base 18 and is located generally opposite to the second portion 32 of the base 18. The projection 34 is generally bulbous, but the projection 34 is not limited to such a shape. The cap 22 preferably includes a recess 36 therein that compliments and/or at least partially receives a portion of the projection 34 therein. The recess 36 is preferably positioned in or near the first end 22*a* of the cap 22. When the cap 22 is in the first position (see FIG. 1), at least a portion of the projection 34 is received and retained within the recess 36. When the cap 22 is in the first position, engagement of the projection 34 and the recess 36 preferably prevents inadvertent sliding of the cap 22 to the second position. When the cap 22 is in the second or third positions (see FIGS. 2-4), the projection 34 is spaced-apart from the recess 36. Engagement of the projection 34 with the recess 36 may create or produce an audible tone or click, to indicate that the cap 22 is fully positioned over the base 18 and that the two are locked or otherwise engaged together (i.e., in the first position). Alternatively or additionally, engagement of the projection 34 and the recess 36 may produce a tactile feel or movement to the user so as to indicate when the cap 22 and the base 18 are properly engaged.

As shown in FIG. 3, a seal or gasket 24 is preferably on or incorporated into an interior surface of the cap 22. More particularly, the seal 24 is preferably attached to at least a portion of the first end 22*a* of the cap 22. Alternatively, at least a portion of the seal 24 may be attached to a portion of the first end 18*a* of the base 18, or even integrally formed with one of the cap 22 and the base 18. At least a portion of the seal 24 is preferably positioned between the passageway 20 and cap 22 when the cap 22 is in the first position (see FIG. 1) to generally fluidically seal the passageway 20. The seal 24 is preferably formed of a resilient, flexible material, such as a rubber or another elastomeric material. The seal 24 may have a generally rectangular shape with an opening (not shown) extending therethrough. The opening of the seal 24 may be approximately the same size as or at least slightly greater than the passageway 20 at the first end 18*a* of the base 18.

When the cap 22 is in the first position (see FIG. 1), the seal 24 is preferably at least partially compressed between at least a portion of the first end 18*a* of the base 18 and an interior of the first end 22*a* of the cap 22 to provide a tight seal over the passageway 20. When the cap 22 is in the first position, the seal 24 preferably extends from the projection 34 to one end of the sloped surface 18*e* or generally the entire width $W_{BF}$ of the first end 18*a* of the base 18 and preferably at least slightly more than the size of the passageway 20. The seal 24 may be any one of a variety sold by TRISEAL CORPORTATION. The seal 24 may be omitted from the combination or the cap 22 is desired.

In operation, the closure 12 preferably allows the user to selectively retrieve and/or dispense even small amounts of the contents or substance from within the cavity 14 of the container 10. The closure 12 may be attached to the container 10 by a user or a consumer, or a manufacturer may attach the closure 12 to the container 10 and sell the combination as a single unit. In an embodiment where the container 10 encloses the contents or substance and the closure 12 is properly attached to the container 10, a user may dispense the contents or substance by sliding or otherwise moving the cap 22 with respect to the base 18 generally perpendicularly to the longitudinal axis A. Once the cap 22 is moved so as to expose at least a portion of the passageway 20, the contents or substance may be dispensed from the container 10, such as by at least partially inverting the container 10 and/or the combination. Once a desired amount of the contents or substance is dispensed, the cap 22 is preferably slid or otherwise moved in a reverse direction so as to close the passageway 20 of the base 18. In the first position (see FIG. 1), the seal 24 preferably maintains the contents or substance within the passageway 20 and/or the cavity 14 in at least a generally gas-tight and/or fluid-tight manner to prevent inadvertent dispensing, leaking or spilling the contents or substance therefrom.

A method of using a combination of the container 10 and the closure 12 includes moving the cap 22 with respect to the base 18 from the first position (see FIG. 1) to the second position (see FIGS. 2-3) to expose at least a portion of the passageway 20. The method further includes at least partially inverting the closure 12 and the container 10 to dispense the contents or substance from within the cavity 14 of the container 10 through the passageway 20 of the base 18. The method also includes moving the cap 22 from the second position (see FIGS. 2-3) to the first position (see FIG.

1) to at least partially block the passageway 20 thereby preventing the contents or substance from the container 10.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A closure for a container, the closure comprising:

a base having a first portion and an underlying second portion fixedly attached thereto and defining a longitudinal axis extending in a direction from the first portion to the underlying second portion, a passageway extending through the first and second portions in a direction generally parallel to the longitudinal axis of the base, a width of the passageway in the first portion, as measured generally perpendicularly to the longitudinal axis, being smaller than a width of the passageway in the second portion, as measured generally perpendicularly to the longitudinal axis, at least a portion of the second portion being configured to be attached to at least a portion of an opening of a container such that the passageway is in registry with at least a portion of the opening;

a cap movably attached to the first portion of the base, the cap being movable between a first position in which at least a portion of the cap blocks at least a portion of the passageway and a second position in which the cap is spaced-apart from at least a portion of the passageway to allow contents from within the container to pass therethrough;

a seal on one of the cap and the base, at least a portion of the seal being positioned and at least partially compressed between the cap and the base when the cap is in the first position to seal the passageway; and at least one first fastening member positioned on or in the first portion of the base, and at least one complementary second fastening member positioned on or in the cap, wherein the second fastening member engages the first fastening member to align the cap with the base.

2. The closure according to claim 1, wherein the cap moves in a direction generally perpendicularly to the longitudinal axis of the base.

3. The closure according to claim 2, wherein a width of the cap, as measured generally perpendicularly to the longitudinal axis, is at least slightly greater than a width of the base, as measured generally perpendicularly to the longitudinal axis.

4. The closure according to claim 1, wherein the first fastening member comprises a groove on or in one of the base and the cap and the second fastening member comprises a rib on or in the other of the base and the cap.

5. The closure according to claim 4, wherein the first fastening member comprises a groove that extends inwardly into at least a portion of the base and the second fastening member comprises a rib that extends inwardly from an interior of the cap.

6. The closure according to claim 1, wherein the first fastening member extends generally perpendicularly to the longitudinal axis across a width of the base, as measured generally perpendicularly to the longitudinal axis, and wherein the second fastening member extends generally perpendicularly to the longitudinal axis across a width of the cap, as measured generally perpendicularly to the longitudinal axis.

7. The closure according to claim 1, wherein the second portion of the base has a reduced cross-sectional area as compared to the first portion, and the cap generally surrounds the entire first portion of the base when the cap is in the first position.

8. The closure according to claim 1, wherein the first portion of the base includes one of a projection and a complementary recess generally opposite to the second portion and the cap includes the other of the projection and the complementary recess, the projection being positioned within the recess when the cap is in the first position and the projection being spaced-apart from the recess when the cap is in the second position.

9. The closure according to claim 1, wherein an interior contour of the cap is generally complementary to an exterior contour of the first portion of the base, such that the cap generally complementarily engages the first portion of the base in the first position thereof.

* * * * *